United States Patent [19]

Inoue et al.

[11] 4,381,856

[45] May 3, 1983

[54] METHOD OF REPAIRING BLAST FURNACE WALL LINING

[75] Inventors: Akihiko Inoue; Hirofumi Inoue; Tsuyoshi Nakamura; Seiji Tobino; Masamitsu Baba, all of Kitakyushu, Japan

[73] Assignee: Nippon Steel Corporation, Tokyo, Japan

[21] Appl. No.: 396,861

[22] Filed: Jul. 9, 1982

[30] Foreign Application Priority Data

Jul. 9, 1981 [JP] Japan ..... 56-106202

[51] Int. Cl.[3] ..... F27D 1/16

[52] U.S. Cl. ..... 266/281; 264/30

[58] Field of Search ..... 266/281, 280, 282, 283, 266/197, 287; 264/30; 29/402.9, 402.14, 402.15, 402.18; 432/76

[56] References Cited

U.S. PATENT DOCUMENTS 3,202,732 8/1965 Braun et al. ..... 264/30

FOREIGN PATENT DOCUMENTS 106376 5/1917 United Kingdom ..... 266/281

OTHER PUBLICATIONS

Reader's Digest, *Complete Do-It-Yourself Manual,* p. 92, 1973, Readers Digest Assn., Pleasantville, N.Y.

*Primary Examiner*—L. Dewayne Rutledge
*Assistant Examiner*—Scott Kastler
*Attorney, Agent, or Firm*—Wenderoth, Lind & Ponack

[57] ABSTRACT

In repairing lining damage in a blast furnace, the furnace is blown down after lowering the burden inside to below the damaged part. Then a plurality of openings and a refractories filling aperture are provided through the furnace wall in the damaged part. A preliminarily prepared panel is lowered down through an opening in the furnace top to a position opposite to the damaged part. One end of a string-like member whose other end is fastened to the panel is drawn outside the furnace through one of the openings. The whole length of the string-like member is protectively covered by a single or double support tube and stretched therethrough. Monolithic refractories are forced in through the refractories filling aperture into a clearance between the damaged part and panel either during blowing down or after blowing in.

5 Claims, 4 Drawing Figures

METHOD OF REPAIRING BLAST FURNACE WALL LINING

This invention relates to a method of repairing a damaged part of the blast furnace lining with monolithic refractories.

BACKGROUND OF THE INVENTION

Incessantly exposed to temperature variations, hot corroding gases as well as the impact and abrasive wear caused by the charge, the refractory linings of blast furnaces are likely to spall, collapse or fall off. In addition to shortening the furnace life, such defective linings also impair the operating performance of the blast furnace as a result of heavy deformations of its vertical and circumferential profiles, especially in the upper and middle parts of the shaft. The misshaped furnace profile causes the reducing gas to rise through the furnace is an uneven pattern, thus creating undesirable turbulences. At the same time, coke and sinter get mixed with each other more readily, bringing about an increase in the coke and other fuel consumption and a drop in productivity through the uneven reducing of the charge.

As a solution for such problems an attempt has been made to inject monolithic refractories through an opening made in the steel shell and furnace wall covering the damaged portion. But it has turned out that the monolithic refractories thus applied do not have the desired durability since they come off easily, lacking adequate adhesiveness, when hit by the descending charge. This method has thus proved unfit for use in the repairing of the shaft of the blast furnace. In addition, this method requires a long repairing time.

SUMMARY OF THE INVENTION

This invention has been made to obviate such shortcomings of the conventional repairing methods.

An object of this invention is to provide a method of repairing the blast furnace linings that assures a high-accuracy minimal-area repairing, providing a high durability in the repaired portion without impairing the strength of the remaining original lining therearound.

Another object of this invention is to provide a method of repairing the blast furnace linings that can be implemented in a short time, thereby remarkably reducing the downtime during which the blast furnace is kept out of operation.

In repairing a damaged part in the blast furnace lining according to the method of this invention, the furnace is blown down by lowering the burden level to below the part needing repairs. Then a plurality of openings through each of which a panel-suspending string is passed and an opening through which refractories are filled are made through the furnace wall. Following this, a refractory preformed panel is vertically let down through an opening in the top of the furnace to a position opposite the damaged part. One end of the string is attached to the panel, with the other end thereof remaining free. That free end of the string is drawn outside through one of the openings, with the entire stretched length of the string protectively covered with a single or double pipe passed through the opening. Then, with the blast furnace either still blown down or blown in, monolithic refractories are injected from outside into the clearance left between the damaged part and suspended panel through the refractories filling aperture.

Firmly protected by the injected refractories and suspended panel that are highly heat-, impact- and corrosion-resistant, the repaired part attains high enough durability to remarkably prolong the furnace life.

This method permits repairing a damaged part of any area and thickness more quickly and efficiently than ever. This, in turn, prevents the repaired part from being damaged by the cooling of the surrounding original lining and sharply reduces the downtime.

Now that the lining profile is properly repaired as desired and with high accuracy, the reducing gas ascends evenly both at the center and in the peripheral region of the furnace, thereby precluding the occurrence of turbulences and the mixing between coke and sinter. The resulting balanced reduction of the charge across the horizontal cross-section of the furnace leads to an improvement in productivity and a reduction in fuel consumption. All this assures a stable, efficient furnace operation.

DETAILED DESCRIPTION OF THE PREFERRED EMBODIMENT

The following paragraphs describe the details of this invention by reference to a preferred embodiment shown in FIGS. 1 through 4.

Figure 1:
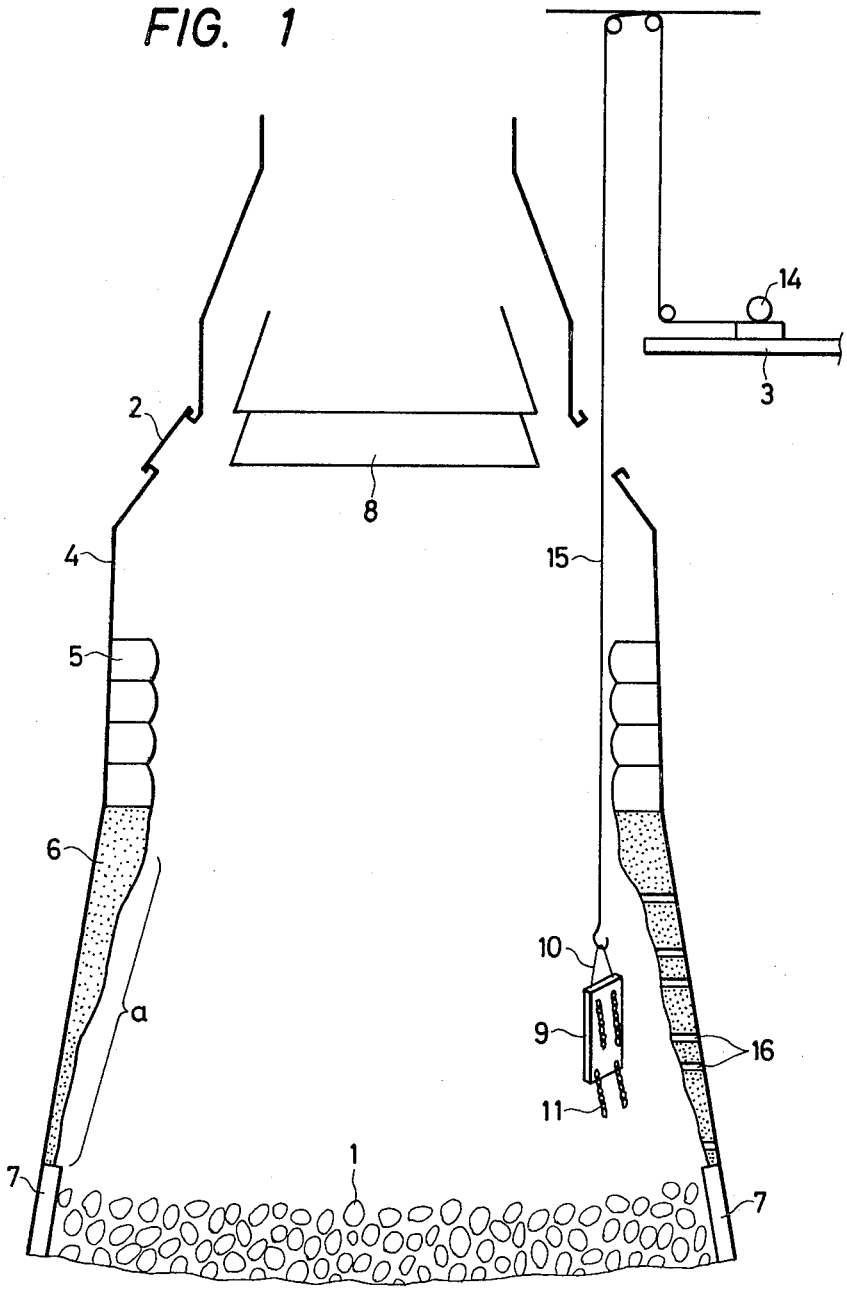
FIG. 1 is a vertical cross section of the upper half part of a blast furnace being repaired according to the method of this invention.

FIG. 1 is a vertical cross section of the upper half portion of a blast furnace in the blown down state with the charge 1 lowered below the damaged part a. The left half of the figure shows the condition before repairing and the right half shows the furnace being repaired according to the method of this invention. In this drawing, reference numeral 2 designates a manhole in the top of the furnace, 3 a working deck, 4 the steel shell of the furnace, 5 the metal armor, 6 the inwall refractory lining, 7 a stave cooler and 8 a bell. All these items are components parts of the existing blast furnace.

Before implementing the repairing method of invention, panels 9 to support the filled-in monolithic refractories must be prepared beforehand. The panels 9 may be made of vibration-fabricated refractories or monolithic refractories reinforced with metal wire netting. With the material quality of the original lining and the in-furnace environment in mind, a choice may be made from among basic, neutral and acid refractories having the desired resistivities against heat, impact, CO and alkali gases, and so on. The width of the panel must not be larger than the diameter of the top opening 2, with its length and thickness determined according to the area and thickness of the damaged part, ease of work, quantity of refractories to be filled-in, and other factors. Several kinds and pieces of panels may be prepared according to the area of the damaged part, each piece having, for instance, a width of 1 m, a length ranging between about 1 and 4 m, and a thickness between about 0.2 and 0.4 m. The panel may also be either flat or curved in conformity with the curvature of the damaged lining.

To the panel 9 are attached a sling 10 that is used when the panel 9 is lowered down into the furnace and a plurality (4 to 8, for instance) of chains 11, the number of the chains 11 depending upon the size of the panel 9. The chain 11 may be replaced by several pieces of rods linked together in a freely bendable manner or otherwise by a rope. As shown in the enlarged partial cross section in FIG. 2, a back-up plate 12 of such material as metal and a contractible sealing member 13 of such material as ceramic fiber may be fastened to the panel in such a manner as to close a clearance between an upper panel 9' and a lower panel 9. This will effectively prevent the leakage of the filled-in refractories.

When the panels 9 are ready, the blast furnace is blown down by lowering the burden 1 to below the damaged part requiring repairs, as shown in FIG. 1. Using a winch 14 temporarily mounted on the deck 3 and a wire rope 15, a panel or pre-joined panels 9 are lowered into the furnace through an opening, like the manhole 2, in the furnace top to a position that is opposite to the lower end of the damaged part a. Then, the chains 11 are drawn outside, one by one, through the corresponding number of openings 16 preliminarily made through the steel shell and furnace inwall by use of a hooked rod (not shown).

Figure 2:
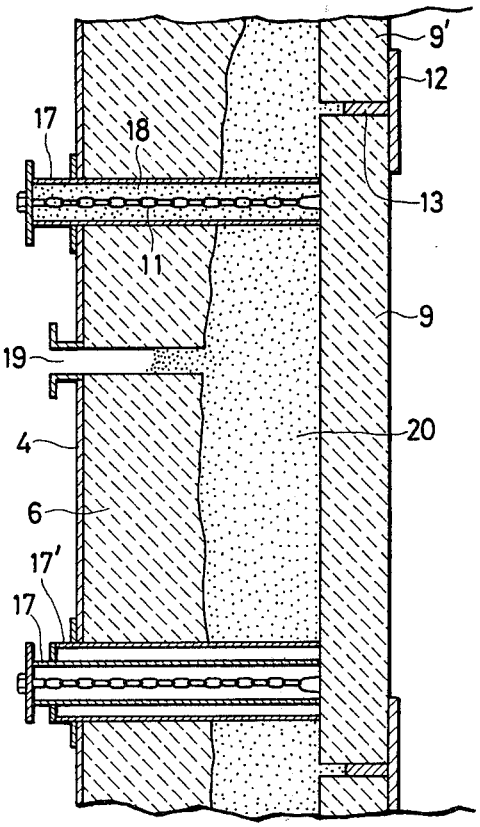
FIG. 2 is an enlarged cross section showing the details of a damaged portion under repair.

Then, a support tube 17 of a given length is inserted from outside the furnace to cover the chain 11, with the chain 11 being stretched and fastened at the rear end of the tube 17, as shown in FIG. 2. By this means, the panel 9 is firmly fastened to the furnace with a given clearance left between itself and the damaged lining 6. The clearance is such that the distance between the panel 9 and the steel shell 4 is substantially equal to the thickness of the original, undamaged refractory lining.

The panel 9 may be supported more firmly if two coaxially disposed tubes 17 and 17' are used instead of the single tube 17, as shown in the lower part of FIG. 2. The chain 11 and panel 9 can be supported still more firmly, with a resulting increase in durability, if the single or double support tube is filled with a heat-resisting refractory material outside the furnace. Instead of filling the tube with the heat-resisting refractory material 18, cooling water can be passed through the tube 17 (and 17'). When the two tubes 17 and 17' are used, it is also possible to place the material 18 in one of them and pass the cooling water through the other. Or, otherwise, a hose (not shown) may be wound around the support tube 17 for carrying cooling water.

By these means, water cooling can be continued even after the blast furnace has been blown in. The panel 9 also can be water-cooled after blowing in by burying therein a hose or other water-cooling pipe communicating with a water supply source outside the furnace. This water cooling restrains the expansion of the panel and thereby prevents its deterioration.

Figure 3:
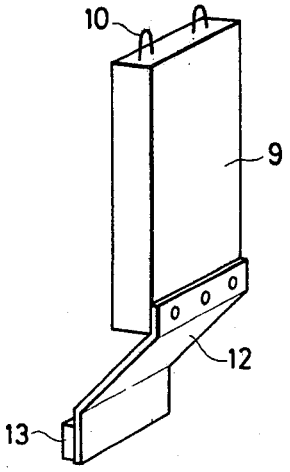
FIG. 3 is a perspective view showing a preferred embodiment of the lowest panel used in implementing the repairing method of this invention.

When the lowest panel 9 has been fixed in position, the winch 3 lifts the unhooked wire rope 15 for lowering the next panel. A downwardly inclined back-up plate 12 may be attached to the lowest panel 9, as shown in FIG. 3, to prevent the leakage or falling of the monolithic refractories to be filled in as described later.

Figure 4:
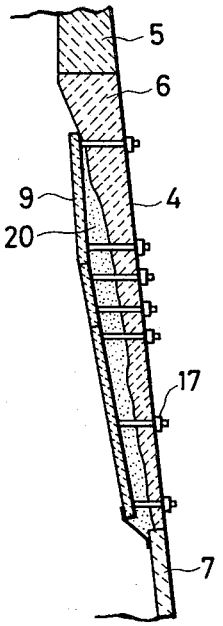
FIG. 4 is a vertical cross section of the furnace lining repaired according to the method of this invention.

By thus putting one panel 9 above another, the damaged part a is covered with a number of panels 9 that are horizontally and vertically fastened together, as shown in FIG. 4. When all the panels 9 have been fastened in position, the furnace top opening 2 is closed to get the furnace ready for blowing in.

Then, monolithic refractories 20 are supplied under pressure into the clearance left between the damaged inwall lining 6 and the panel 9 through the refractories filling aperture 19 preliminarily made through the steel shell 4 and furnace wall 6. The refractories 20 fill the clearance and solidify quickly under the intense heat (several-hundred degrees centigrade) inside the blast furnace and its walls.

The refractories filling aperture 19 should preferably be a little above the center of each panel 9, as shown in FIG. 2. The refractories 20 can be supplied to a plurality of panels 9 through one filling aperture 19 when the panel size is small. It is therefore desirable to give adequate consideration to the positional relationship between the filling aperture 19 and the panels 9 in their design stage.

The monolithic refractories 20 may be chosen from among fire-proof mortar and castable refractories available on the market or to which may be mixtures added coke and sinter fines, taking into account their heat-, impact- and corrosion-resisitivity and hardenability.

The monolithic refractories 20 can be supplied in either of the following two ways: in the dry state with air, nitrogen or other carrying gases, or in with water, oil or other carrying liquids. On completion of filling, the aperture 19 is closed.

The supplying of the monolithic refractories 20 and the heat-resisting refractory material 18 in the support tube 17 may be conducted either as each panel is fastened or after all the panels have been fastened. Further, in the upper part of the blast furnace where the burden remains unmelted, the refractories can be supplied even after the furnace has been blown in, permitting a further shortening of the furnace downtime.

Solidifying in a tightly packed condition, without leaking, between the inwall lining 6 and panel 9, the filled-in refractories do not fall off even after the furnace has been put into operation again.

The combination of the filled-in refractories 20 and the panel 9 not only repairs, and firmly protects, the damaged lining but also adequately makes up for the loss in furnace rigidity resulting from the provision of openings in the steel shell.

When corroded or otherwise damaged after several years of service after blowing in, the panel 9 may be by detaching the support tube 17 from the steel shell 4 and pushing it inside the furnace and, then, readily replaced with a new panel according to the method previously described.

The foregoing example concerns the repairing of the inwall lining of an existing blast furnace. The repairing method of this invention is also applicable to the construction of new blast furnaces, in which case the chain-passing openings 16 and filling aperture 19 are provided preliminarily and the monolithic refractories 20 are injected into space left between the steel shell 4 and the fastened panel 9. All this shortens the furnace construction period greatly and facilitates the replacement of damaged panels.

What is claimed is:

1. A method of repairing the wall lining of a blast furnace comprising the steps of:

blowing down the blast furnace after lowering the burden therein to below the damaged part of the lining;

making, after the blowing down, a plurality of openings and a refractories filling aperture through the furnace wall in the damaged part;

lowering a panel of refractory material through an opening in the furnace top to a position opposite to the damaged part;

drawing outside the furnace through one of said openings one end of a string-like member whose other end is attached to said panel, the entire length of the string-like member being protected and stretched through a support tube passed through said openings; and supplying, under pressure, monolithic refractories through said filling aperture into a clearance between the damaged part and panel either during blowing down or after blowing in.

2. A method according to claim 1, in which the support tube is a double tube.

3. A method according to claim 1, in which said support tube is filled with a heat-resisting refractory material after the string-like member has been passed therethrough.

4. A method according to claim 1, in which the support pipe is cooled by water passed therethrough.

5. A method according to claim 2, in which the string-like member is passed through the inner tube which is then filled with a heat-resisting refractory material which is then allowed to solidify therein, and water is passed through the external tube to cool the whole support tube.

* * * * *